US007460075B2

(12) United States Patent
Ju

(10) Patent No.: US 7,460,075 B2
(45) Date of Patent: Dec. 2, 2008

(54) ANTENNA AND ITS IMPROVED FRAMEWORK FOR SOLDERING ELECTRIC WIRE

(76) Inventor: Ted Ju, No. 15, Wu-Shiun Street, Anle District, Keelung, 204 (TW)

( * ) Notice: Subject to any disclaimer, the term of this patent is extended or adjusted under 35 U.S.C. 154(b) by 440 days.

(21) Appl. No.: 11/430,839

(22) Filed: May 10, 2006

(65) Prior Publication Data

US 2007/0262907 A1 Nov. 15, 2007

(51) Int. Cl.
*H01Q 1/24* (2006.01)

(52) U.S. Cl. ..... 343/702; 343/700 MS; 343/767

(58) Field of Classification Search ..... 343/700 MS, 343/702, 767, 904, 905, 906
See application file for complete search history.

(56) References Cited

U.S. PATENT DOCUMENTS 6,600,448 B2 * 7/2003 Ikegaya et al. ..... 343/700 MS
6,917,333 B2 * 7/2005 Ikegaya et al. ..... 343/700 MS
7,230,573 B2 * 6/2007 Lin et al. ..... 343/700 MS
7,248,220 B2 * 7/2007 Futamata ..... 343/700 MS
7,318,268 B2 * 1/2008 Ikegaya et al. ..... 29/600

* cited by examiner

*Primary Examiner*—HoangAnh T Le
(74) *Attorney, Agent, or Firm*—Ming Chow; Sinorica, LLC

(57) ABSTRACT

Antenna and its improved framework for soldering electric wire is disclosed, comprising: an antenna comprising a radiator, a grounding electrode and a connection portion which connects the radiator and the grounding electrode and which is provided with a slit, and a soldering zone provided on the radiator and the grounding electrode of the respective side of the slit to couple with an electric wire; and an anti-soldering material provided on the soldering zone. Compared with the conventional prior art, the antenna and its improved framework for soldering electric wire provided with anti-soldering material in the soldering zone of the antenna can accurately position the solder to avoid uncontrolled diffusion of solder, reduce satisfactory soldering, and increase signal transmission stability to render the operation simple and easy.

9 Claims, 4 Drawing Sheets

ANTENNA AND ITS IMPROVED FRAMEWORK FOR SOLDERING ELECTRIC WIRE

FIELD OF THE INVENTION

The present invention relates to antenna and its improved framework for soldering electric wire and particularly to an improved soldering framework of antenna, which is provided with anti-soldering paint.

BACKGROUND OF THE INVENTION

In the today's technology society, antenna has become an indispensable device for the wireless connection of communication products. Furthermore, there is a trend of minimization of communication devices, mobile phone for example. Other examples include the integration of communication device with notebook, personal digital assistant (PDA), and so on.

The design of antenna has to go hand in hand with the minimization of communication devices. The technology in the minimization of the design of antenna has been matured; microstrip antenna and planar inverted F antenna are two examples of this trend. China patent No. 02230247.6, for example, disclosed a planar inverted F antenna, in which the core conductive wire 61 of the cable 6 is directly soldered on the lower end of the side 41 of the connection portion 4.

On Feb. 6, 2002, China patent No. 00119455.0 disclosed an antenna which can be installed in a portable electronic facility and work under ISM broadband. As shown in FIG. 1, the planar printed antenna is, in a direct feeding mode, to solder the inner conductor 301 (equivalent to core wire) and the external conductor 302 (equivalent to ground wire) of the coaxial cable feeder 30 (equivalent to electric wire) with the first layer plane 101 (equivalent to radiator) and the second layer plane 102 (equivalent to grounding electrode) of an antenna printed circuit board.

This way of soldering the internal and external conductors directly on the antenna body (the core wire 61 and the metal braided layer disclosed in China patent No. 02230247.6, and the internal and external conductors 301 and 302 disclosed in China patent No. 00119455.0) usually encounters unsatisfactory soldering due to incorrect soldering location resulted from uncontrolled diffusion of solder. Also, antenna is a very sensitive device whose function is greatly influenced by the amount, shape, and location of solder applied; therefore, the signal transmission is affected.

Consequently, it is necessary to design a new antenna and its improved framework for soldering electric wire to overcome the drawbacks described above.

SUMMARY OF THE INVENTION

An object of the present invention is provide antenna and its improved framework for soldering electric wire to avoid uncontrolled diffusion of solder, reduce satisfactory soldering, and increase signal transmission stability to render the operation simple and easy.

To achieve the objects described above, the antenna and its improved framework for soldering electric wire according to the present invention, comprising: an antenna comprising a radiator, a grounding electrode and a connection portion which connects the radiator and the grounding electrode and which is provided with a slit, and a soldering zone provided on the radiator and the grounding electrode of the respective side of the slit to couple with an electric wire; and an anti-soldering material provided on the soldering zone.

Compared with the conventional prior art, the antenna and its improved framework for soldering electric wire provided with anti-soldering material in the soldering zone of the antenna can accurately position the solder to avoid uncontrolled diffusion of solder, reduce satisfactory soldering, and increase signal transmission stability to render the operation simple and easy.

BRIEF DESCRIPTION OF THE DRAWINGS

The present invention can be more fully understood by reference to the following description and accompanying drawings, in which.

DETAILED DESCRIPTION OF THE INVENTION

Figure 1:
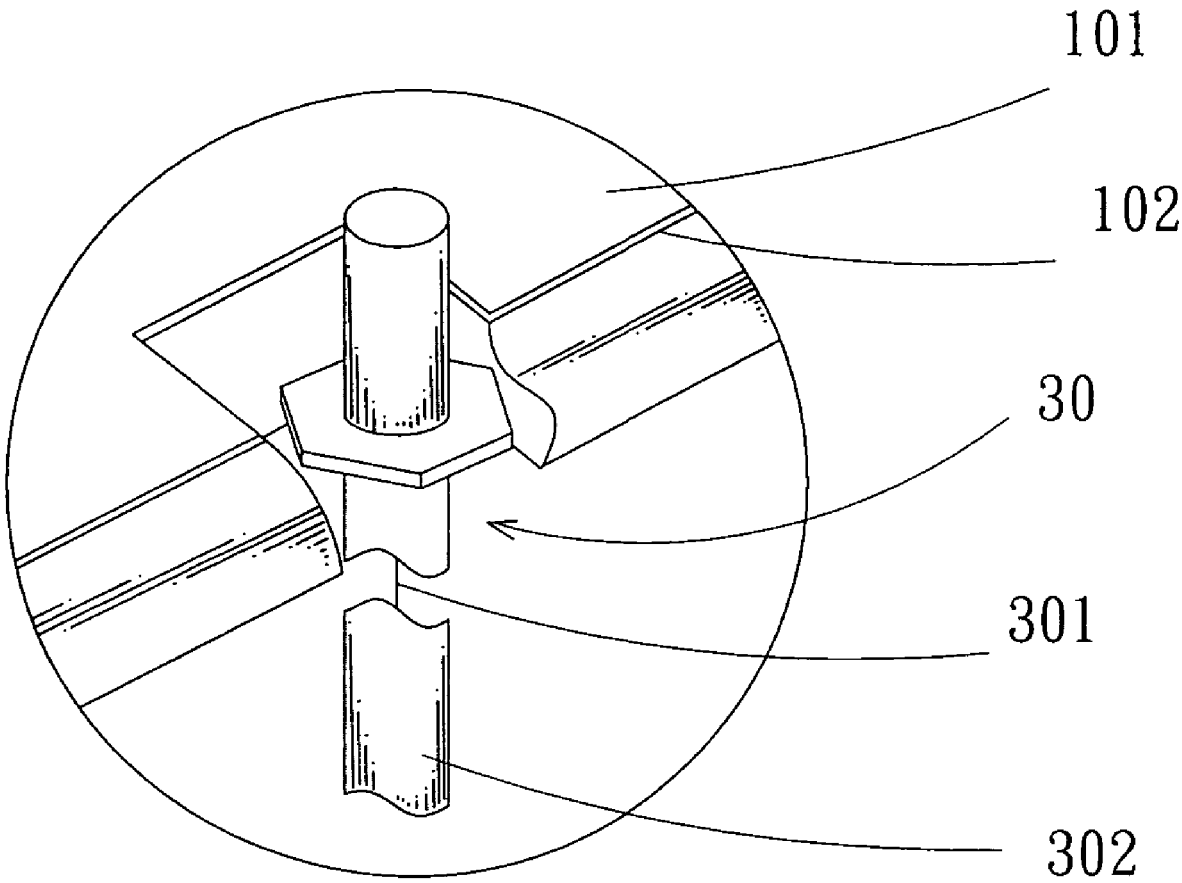
(PRIOR ART) FIG. 1
FIG. 1 schematically illustrates the perspective assembly view of a conventional prior art of a planar printed antenna.
Figure 2:
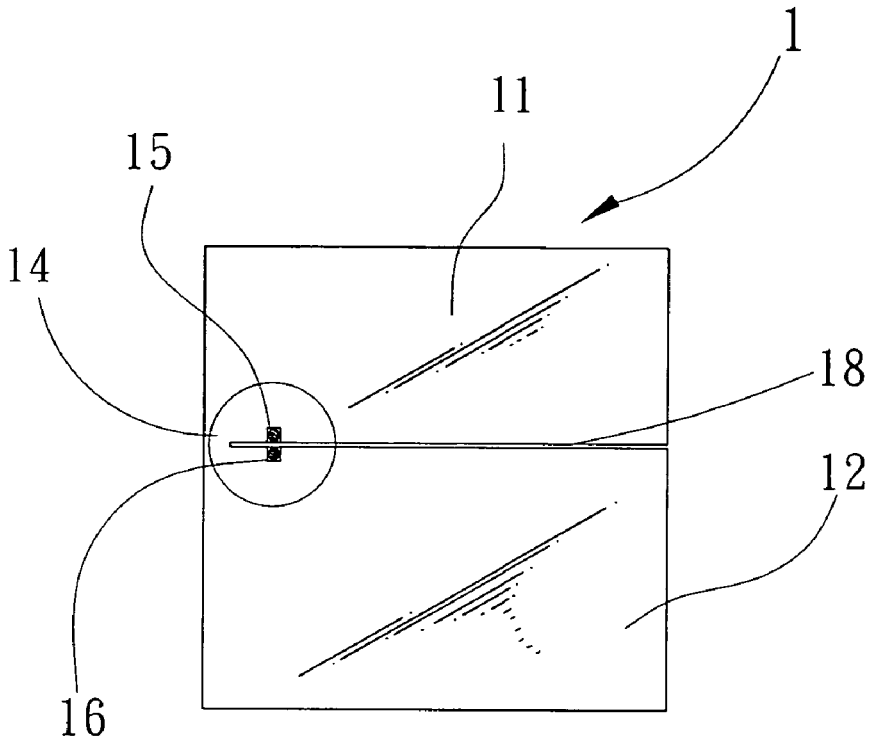
FIG. 2 schematically illustrates the plane view of a preferred embodiment of the antenna and its improved framework for soldering electric wire according to the present invention.
Figure 3:
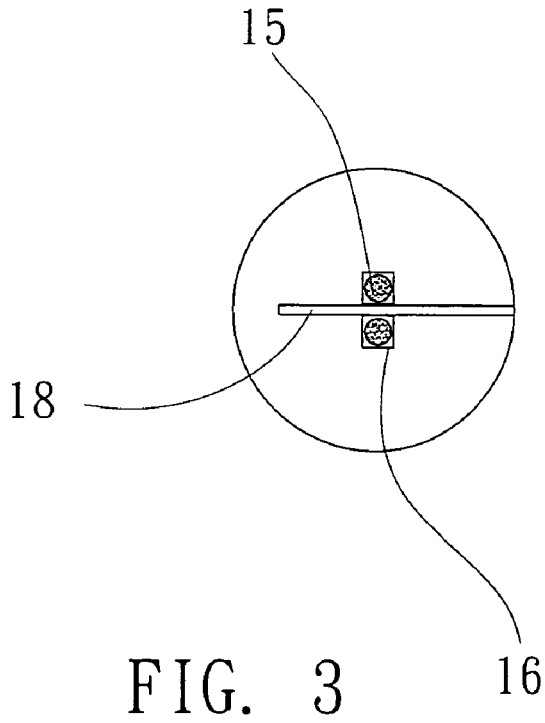
FIG. 3 schematically illustrates a partial enlargement of the antenna and its improved framework for soldering electric wire shown in FIG. 2.

Referring to FIGS. 2 and 3, the antenna with an improved framework for soldering electric wire according to the present invention is used in electronic devices to receive or transmit signals. The antenna 1 according to the present invention comprises an radiator 11, a grounding electrode 12, and a connection portion 14 connecting the radiator 11 and the grounding electrode 12, wherein the radiator 11 and the grounding electrode 12 are metal plates integrally formed by stamping sheet metal or formed by other processes (not shown). The radiator 11 and the grounding electrode 12 of the antenna 1 are positioned in the same plane (certainly, they can be positioned on different planes and bended, not shown).

A transverse slit 18 is provided at a certain distance right of the connection portion 14 between the radiator 11 and the grounding electrode 12. The transverse slit 18 is open crack; a soldering zone 16 provided on the radiator 11 and the grounding electrode 12 of the respective side of the slit 18. The soldering zone 16 is further provided with anti-soldering material 15, which is, for example but not limited to, an anti-soldering paint applied around or inside the soldering zone 16. For the sake of explanation, the anti-soldering material 15 is provided inside the soldering zone 16 in FIGS. 2 and 3.

Figure 4:
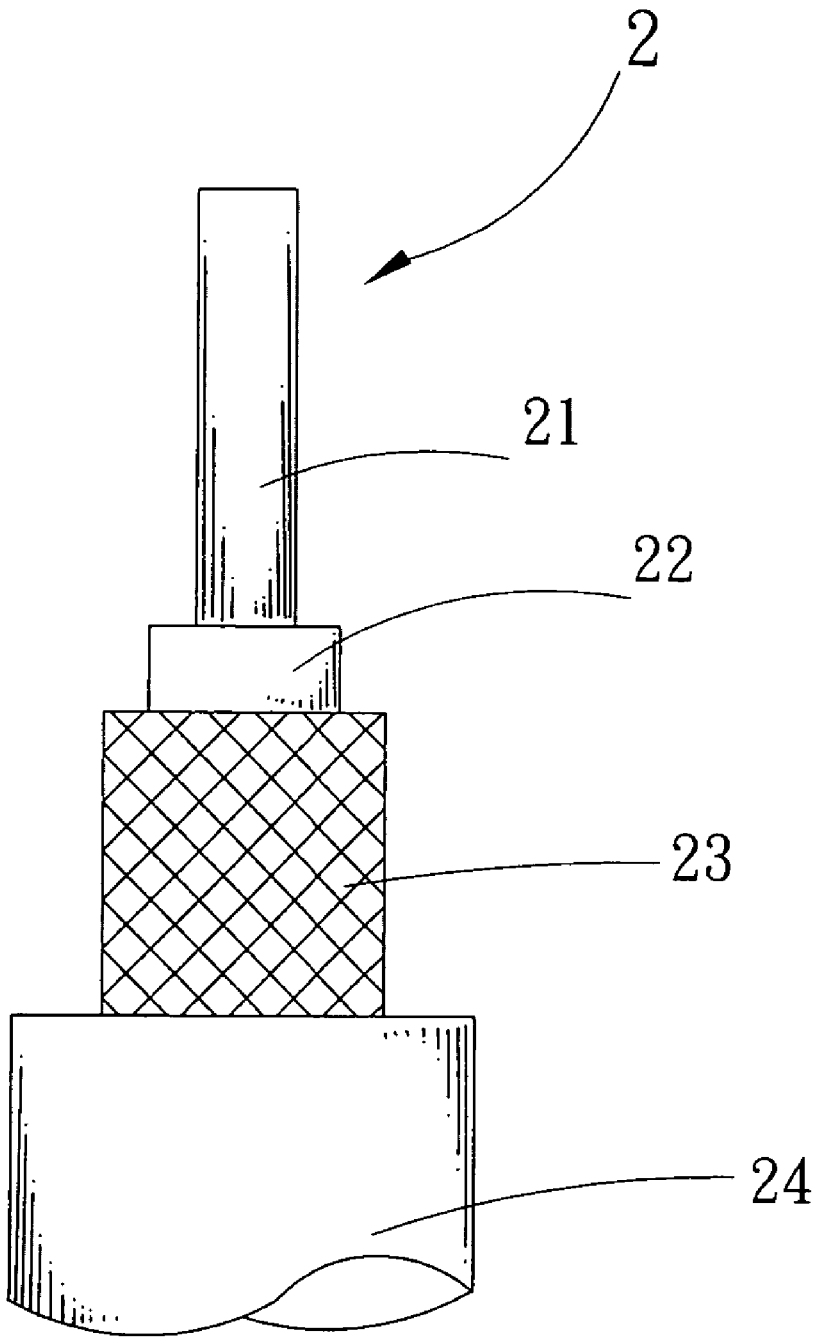
FIG. 4 schematically illustrates the perspective view of a preferred embodiment of the electric wire of the antenna and its improved framework for soldering electric wire according to the present invention.

Referring to FIG. 4, the electric wire is a coaxial cable 2, further comprising: a core wire 21; an inner insulating layer 22 to shield the core wire 21; a grounding wire 23 which is a braided metal layer to enclose the inner insulating layer 22; and an outer insulating layer 24 enclosing the exterior.

Figure 5:
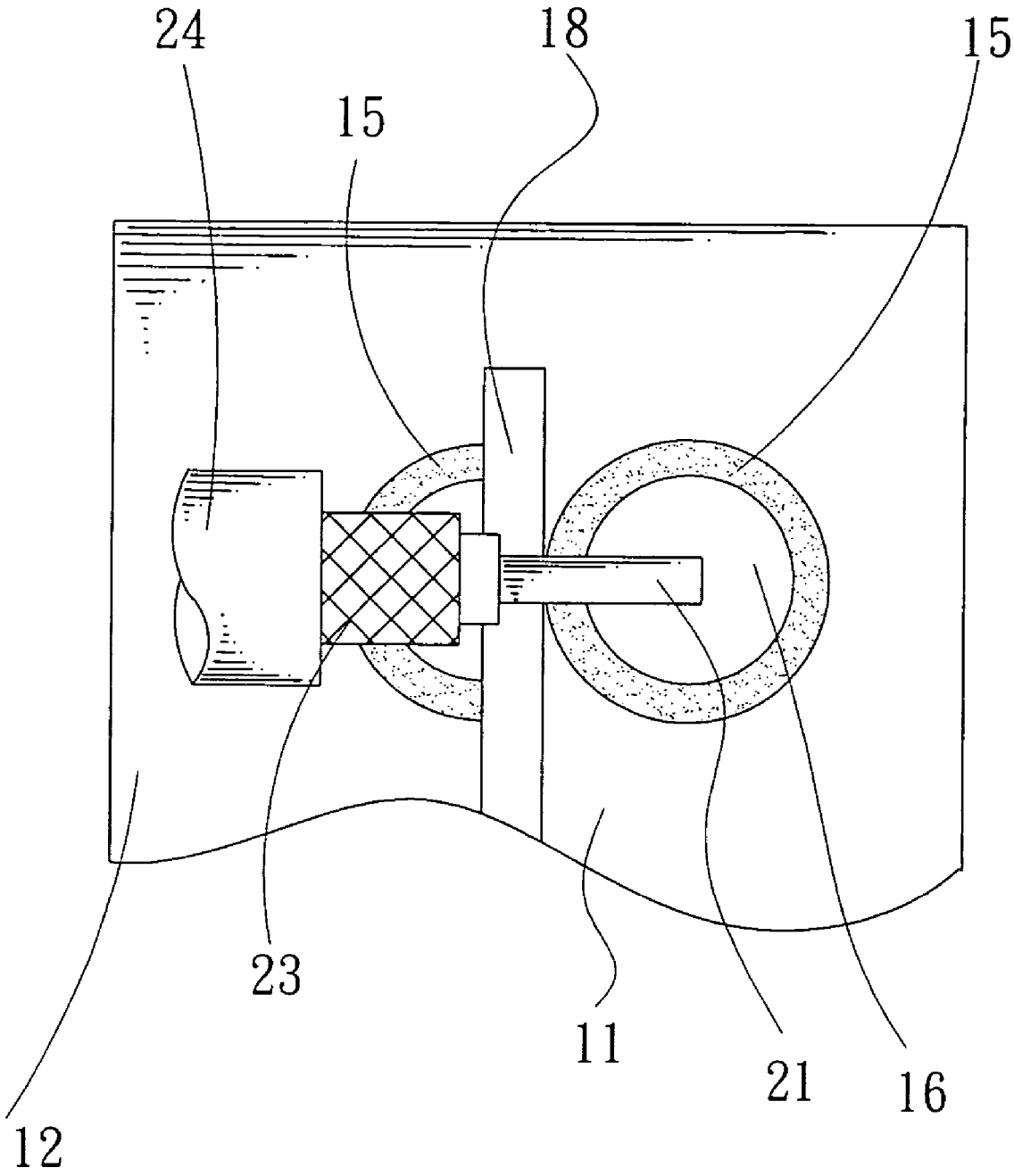
FIG. 5 schematically illustrates the perspective view of the antenna and its improved framework for soldering electric wire according to the present invention.

Referring to FIG. 5, the anti-soldering material 15 is provided around the soldering zone 16, wherein the core wire 21 is connected with the radiator 11 of the antenna 1 to provide the antenna 1 with a signal circuit system (familiar to one skilled in the field, not shown). The grounding wire 23 is connected with the grounding electrode 12 of the antenna 1 to connect to the ground phase of the system.

When soldering is being conducted, the anti-soldering material 15 (anti-soldering paint) is applied around or inside the soldering zone 16 and then the coaxial cable 2 is soldered with the antenna 1. As a result, the melting solder (not shown) will be contained within the area applied with the anti-soldering material 15 during soldering process to increase the precision of the soldering location and prevent the uncontrolled diffusion of solder from affecting the performance of the antenna 1, and thus increase the stability of the signal transmission.

Consequently, by the putting the antenna and the improved framework for soldering wire according to the present invention, the soldering zone of the antenna is applied with a layer of anti-soldering material to render the melting solder contained within the area provided with anti-soldering material during soldering process, so as to accurately position the solder to avoid uncontrolled diffusion of solder, reduce satisfactory soldering, and increase signal transmission stability to render the operation simple and easy.

While the invention has been described with reference to the a preferred embodiment thereof, it is to be understood that modifications or variations may be easily made without departing from the spirit of this invention, which is defined by the appended claims.

What is claimed is:

1. An antenna and its improved framework for soldering electric wire, comprising:

an antenna comprising a radiator, a grounding electrode and a connection portion which connects the radiator and the grounding electrode and which is provided with a slit, and a soldering zone provided on the radiator and the grounding electrode of the respective side of the slit to couple with an electric wire; and an anti-soldering material provided on the soldering zone.

2. The antenna and its improved framework for soldering electric wire as defined in claim 1, wherein the anti-soldering material is an anti-soldering paint.

3. The antenna and its improved framework for soldering electric wire as defined in claim 2, wherein the anti-soldering paint can be applied around the soldering zone.

4. The antenna and its improved framework for soldering electric wire as defined in claim 1, wherein the slit is a transverse slit.

5. The antenna and its improved framework for soldering electric wire as defined in claim 4, wherein the transverse slit is provided at a certain distance right of the connection portion.

6. The antenna and its improved framework for soldering electric wire as defined in claim 1, wherein the electric wire is a coaxial cable.

7. The antenna and its improved framework for soldering electric wire as defined in claim 6, wherein the coaxial cable further comprises a core wire, an insulating layer to shield the core wire; and a grounding wire of braided metal layer to enclose the insulating layer.

8. The antenna and its improved framework for soldering electric wire as defined in claim 7, wherein the core wire and the grounding wire are soldered with the radiator of the antenna and the soldering zone of the grounding electrode, respectively.

9. The antenna and its improved framework for soldering electric wire as defined in claim 7, wherein the core wire and the grounding wire are soldered on the soldering zone of the respective side of the slit, respectively.

* * * * *